United States Patent [19]

Bryant et al.

[11] Patent Number: 4,752,348

[45] Date of Patent: Jun. 21, 1988

[54] LOCALIZED LIQUID ADDITIVE APPLICATOR SYSTEM FOR CONTINUOUS CYLINDRICAL PRODUCT

[75] Inventors: Ronald O. Bryant, Charlotte; William L. Millen; Robert E. Swander, both of Pineville, all of N.C.

[73] Assignee: Celanese Corporation, New York, N.Y.

[21] Appl. No.: 929,953

[22] Filed: Nov. 12, 1986

Related U.S. Application Data

[62] Division of Ser. No. 717,362, Mar. 29, 1985.

[51] Int. Cl.[4] ..... B31F 1/00

[52] U.S. Cl. ..... 156/201; 156/180; 264/136; 264/174; 493/42; 493/49; 131/343; 131/345

[58] Field of Search ..... 131/343, 345; 264/136, 264/174; 156/180, 441; 493/42, 49, 50

[56] References Cited

U.S. PATENT DOCUMENTS

| | | | |
|---|---|---|---|
| 3,017,309 | 1/1962 | Crawford et al. | 156/180 |
| 3,026,226 | 3/1962 | Touey et al. | 156/180 |
| 3,043,736 | 7/1962 | Touey | 156/180 |
| 3,079,930 | 3/1963 | Cobb, Jr. et al. | 156/180 |
| 3,079,978 | 3/1963 | Cobb, Jr. et al. | 156/180 |
| 3,099,594 | 7/1963 | Caines et al. | 156/152 |
| 3,106,501 | 10/1963 | Cobb, Jr. et al. | 156/180 |
| 3,157,536 | 11/1964 | Caines | 118/225 |
| 3,387,992 | 6/1968 | Arthur et al. | 427/240 |
| 3,413,698 | 12/1968 | Fritz et al. | 131/343 |
| 3,501,361 | 3/1970 | Touey et al. | 156/180 |
| 3,560,298 | 2/1971 | McArthur et al. | 156/376 |
| 3,618,619 | 11/1971 | Kiefer | 131/266 |
| 3,656,484 | 4/1972 | Roberts et al. | 131/267 |
| 3,800,676 | 4/1974 | Levers et al. | 493/44 |
| 3,852,009 | 12/1974 | Roberts et al. | 425/83 |
| 4,476,807 | 10/1984 | Pryor | 118/317 |

FOREIGN PATENT DOCUMENTS

| | | | |
|---|---|---|---|
| 689575 | 6/1964 | Canada | 156/180 |
| 744449 | 2/1956 | United Kingdom | 131/345 |

OTHER PUBLICATIONS

Hollander, Jr., Defensive Publication No. T892,016 (11/23/71).

Touey et al., Defensive Publication No. T859,008 (2/4/69).

*Primary Examiner*—Richard Bueker

*Assistant Examiner*—Alain Bashore

*Attorney, Agent, or Firm*—Robert J. Blanke; Forrest D. Stine

[57] ABSTRACT

A continuous rod of a product such as a cigarette filter material is coated with a treating liquid by being passed axially through a cylindrical applicator zone comprising a permeable cylindrical wall, the cylindrical wall being concentrically enclosed within a reservoir and manifold zone connected to a source of liquid. The feed supply for the liquid additive can be pressurized and/or heated, so that application of the additive can be in either liquid or vapor form. The process and apparatus of this invention may be used alone or in conjunction with prior art homogeneous applicators and processes.

When used to apply a plasticizer to a rod of continuous filament tow, e.g. for use in producing cigarette filters, annular regions of varying concentrations of the plasticizer are produced in the rod. A relatively dense region of plasticized fiber can be produced on the outside of the filter. Filter rods having wrapping paper uniformly adhered about the periphery of the rod can be produced. By installing the applicator apparatus between the transport jet and the garniture tongue of a typical cigarette filter rod making machine, the invention permits the production of satisfactory paper wrapped filter rods having unique depression on loading characteristics.

5 Claims, 2 Drawing Sheets

Fig. 1
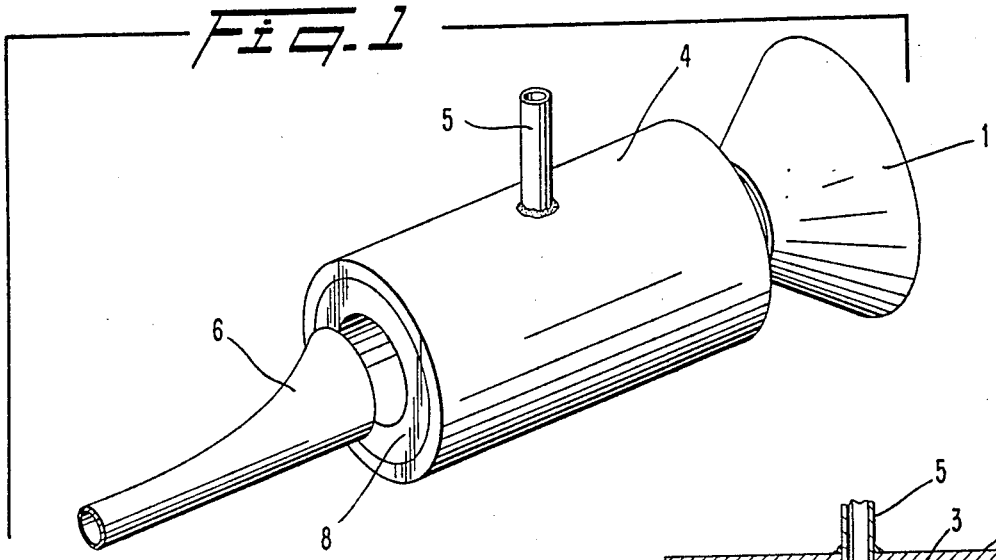
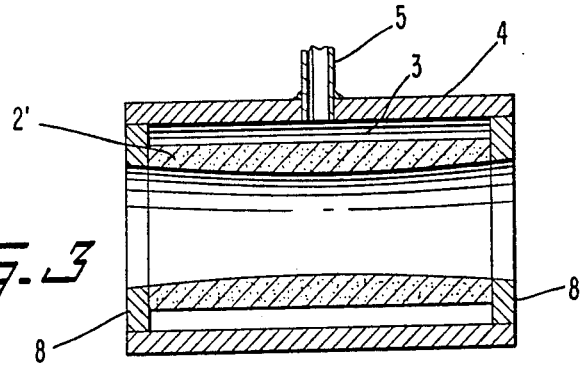
Fig. 3
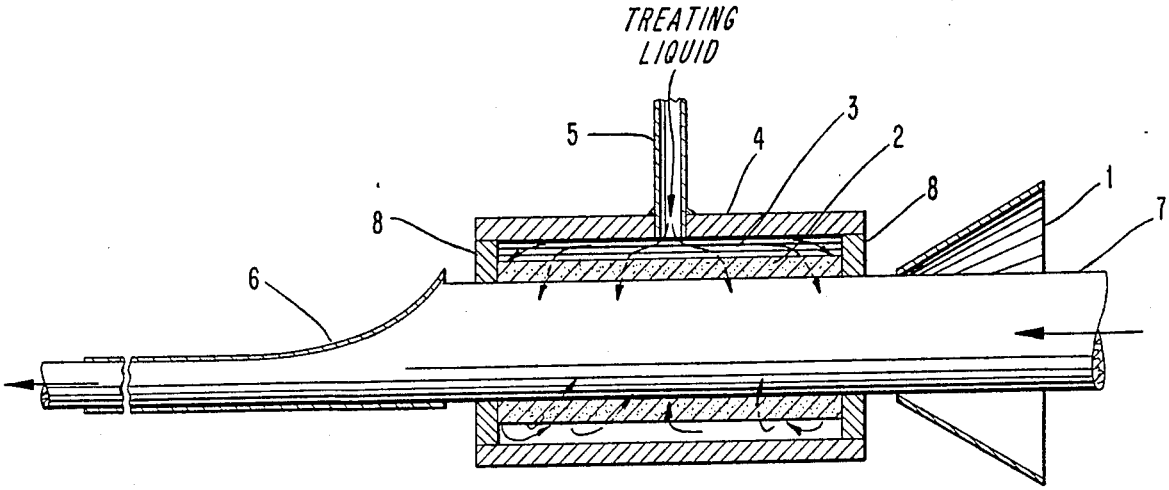
Fig. 2

LOCALIZED LIQUID ADDITIVE APPLICATOR SYSTEM FOR CONTINUOUS CYLINDRICAL PRODUCT

This is a division of application Ser. No. 717,362 filed Mar. 29, 1985 now U.S. Pat. No. 4,655,230.

BACKGROUND OF THE INVENTION

The invention relates to a method for the application of liquid additives to the surface of continuous cylindrical products, for instance, a continuous filament rod such as is used in the manufacture of cigarette filters. Such fibrous rods are typically formed from a filamentary tow material comprising, e.g. cellulose esters such as cellulose acetate. Various methods are known for applying liquid additives such as plasticizers to the tow material to provide substantially uniform distribution of the additive throughout the tow, after which the material is compacted into a cylindrical rod, wrapped with paper known as plug wrap and, if desired, treated by the application of steam or hot air to accelerate "curing" or the action of the plasticizer on the tow material. Cigarette filter rod making machines are usually equipped with a center glue-line applicator. The center glue-line applicator is that part of the filter rod maker which applies glue to the paper that wraps the filter rod to bond the filter material to the wrapper.

One heretofore desired effect has been the relatively uniform interbonding among the fibers in the filter rod to form a relatively homogeneous structure of the desired density and resilience. For instance, Caines et al disclose in U.S. Pat. No. 3,099,594, FIG. 4, a circular air jet apparatus for the application and distribution of plasticizer to a bloomed or expanded bundle of tow, in which plasticizer can be introduced through the walls of the air jet in aerosol form. U.S. Pat. No. 3,157,536 (Caines) discloses an applicator having a cylindrical form wherein a plasticizer liquid flows into a cylindrical chamber, thereafter flowing outward through a slit in the side which is covered with screen and/or felt material. The system is used to coat a flattened tow ribbon rated with a liquid, the porous medium being retained in a combination holder and reservoir which is fed from a source of the coating liquid.

Although industrial processes for producing continuous cylindrical products such as fibrous rods suitable for the production of cigarette filters have been developed to a high degree, there is a continuing requirement for processes by which products meeting existing or higher standards can be produced, preferably with reduced consumption of energy and basic materials such as the tow and plasticizer used. Among the performance criteria considered in the evaluation of cigarette filters are filtration efficiency, pre-selected compressibility, plug wrap adherence and total weight.

Accordingly, it is an object of the present invention to provide an improved process for the application of liquid additives to a continuous cylindrical porous product. A more specific object is to provide an improved process for the peripheral application of a treating fluid such as a plasticizer to a continuous filament rod for the manufacture of cigarette filters. Another object is to provide a combined process for the combination of conventional homogeneous application of a treating fluid together with peripheral application of a treating fluid to a continuous filament rod. A further object of the invention is to provide a process for the application of a plasticizer to the surface of a continuous filament rod wherein a finished cigarette filter of desirable performance standards can be obtained while using a reduced amount of treating fluid per unit filter basis. A still further object of the invention is to provide a cigarette filter rod wrapped with plug wrap paper which is firmly adhered about the periphery of the filter rod without the application of a center-glue line.

Other objects and advantages of the present invention will be apparent to those skilled in the art from perusal of the following detailed description, the drawings and the appended claims.

SUMMARY OF THE INVENTION

In accordance with this invention a process is provided for coating a continuous cylindrical rod of a po- FIG. 2 is a side sectional view of the apparatus of FIG. 1 with a rod of product passing through.

FIG. 3 is a side sectional view of an embodiment of the inner cylinder of the apparatus of FIG. 1.

DETAILED DESCRIPTION OF THE INVENTION

Figure 4:
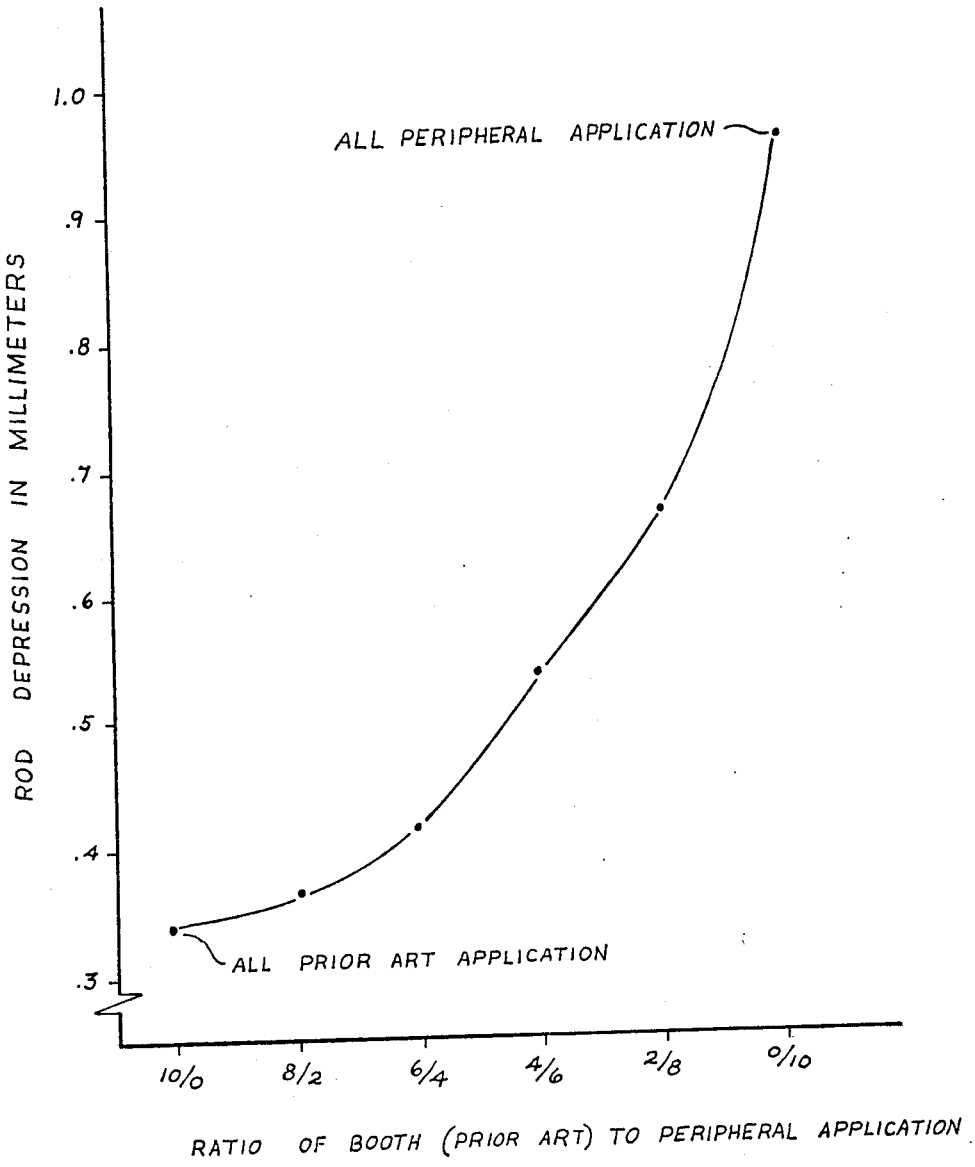
FIG. 4 is a graph plotting rod depression on loading against plasticizer application system.

FIGS. 1 and 2 illustrate an apparatus which can be used to practice the present invention in applying a liquid additive to a continuous cylindrical product such as a fibrous rod for the production of cigarette filters. The transport jet or funnel (1) is used to compact a filamentary tow into a compacted bundle of approximately the diameter of inner cylinder (2) of the apparatus, which defines the applicator zone. This apparatus can be installed directly downstream of a transport jet as used in a tow opening unit such as the Hauni KDF-2/AF-2 system manufactured by Hauni-Werke Korber and Co. KG of Hamburg, West Germany. In such a system, the tow is typically opened into a wide ribbon which is passed through a plasticizer applicator for the uniform or homogenous application of plasticizer as in U.S. Pat. Nos. 3,800,676 and 3,387,992.

However, the apparatus to be described can likewise be used in this invention for applying treating liquids or liquid additives of various types of coat a continuous cylindrical product of any type, and the present discussion of cigarette filter materials is only exemplary. Similarly, the process of the present invention can be used in addition to, or under proper conditions in lieu of, the uniform application of plasticizer to the filamentary tow material prior to its compaction into a cylindrical product. Inner cylinder (2), described hereinafter, is a permeable structure which permits an appropriate flow of the additive liquid from its outer surface adjoining a cylindrical plenum chamber (3) to its inner surface. The plenum chamber (3) is defined by the space between the outer surface of the permeable inner cylinder and the inner surface of the outer cylinder (4). Closures (8) are provided at each end of the apparatus so that once the treating liquid enters through at least one supply tube (5), it can escape only by passage through the porous or permeable inner cylinder. The chamber (3) therefore serves as a combination reservoir and manifold, distributing the liquid evenly around the entire periphery of the inner cylinder when the chamber is filled. The chamber can be pressurized by the use of at least one metering pump (not shown) in the feed tubes, and/or a reservoir (not shown) which provides a relatively constant or variable hydrostatic head to each such feed tube.

To carry out the invention, conventional means are provided for pulling the continuous fiber bundle (7) through the apparatus. Garniture tongue (6) in the figure is a typical garniture as used in the Hauni KDF system, which simultaneously compresses the cylindrical product to size and pulls it through the apparatus, applying a paper wrap at the same time. As the fiber bundle is pulled through inner cylinder (2), it preferably comes in wiping contact with the inner surface of cylinder (2), thereby becoming uniformly coated with the liquid additive in achieving a smooth outer surface. Inner cylinder (2) is typically of substantially uniform inner diameter, but it can be advantageous to have this diameter decrease slightly in at least one location between the point at which the fiber bundle enters the apparatus and its exit as shown in FIG. 3, the resulting constriction providing a shaping or compaction function, wiping liquid onto the fiber bundle, and forcing the newly applied coating of liquid additive into the fibers. For instance, the diameter of the constricted portion or portions can be 5% to 20%, preferably 5% to 10%, smaller than the inner diameter of the major portion of the inner tube.

If desired, heating apparatus (not shown) can be included in the feed tubes to the apparatus to heat or vaporize the liquid additive. With the plenum chamber filled with a vapor of the liquid additive under pressure, the additive coats the fiber bundle by condensing on it as the fiber bundle passes through the apparatus. In another embodiment, with an inner tube of suitable porosity and a suitable pressure applied to the plenum chamber, the liquid additive can be made to pass through the inner cylinder and emerge therefrom in vapor form before being absorbed by the fiber bundle. The apparatus can include means for temperature control of the plenum chamber, such as heating means to permit the liquid additive to pass through the inner cylinder at the proper rate to coat the surface of the fiber bundle as it passes through and to penetrate to the appropriate extent and to interact with the filter material to the desired degree.

The effect of application of a liquid plasticizer to a fiber bundle from filamentary tow material is to provide a cylindrical product having a radially variable concentration of plasticizer, and thus a variable density of the cured filter material, the density and additive concentration decreasing along a gradient from the outer surface to the center of the cylinder. Depending on the curing processes which are employed, the fibers can be lightly interbonded so as to provide structural integrity with little interference to the passage of gases through the filter, or the outer surface can be more extensively cured and/or coated with resinous additives to provide a smooth outer skin of closely bonded filaments which are resistant to the passage of gas.

The inner cylinder (2) can be made of any suitable material which provides the required porosity or permeability and structural strength. For example, metal or synthetic polymers can be used in structures which are perforated, slotted, woven as in fine wire mesh, or sintered to provide the appropriate porosity. Ceramics or glass can also be used to provide a smooth surface which is perforated or slotted, or a porous material such as fritted glass. The pore size or mesh size and overall permeability of the material can be selected according to the viscosity of the treating liquid, the applied pressure and desired flow rate (flux), the presence of particulate material, and the like. For example, to coat a typical cigarette filter rod with a cellulose ester plasticizer using an applied pressure in the range from about 5 to about 50 psi, the permeability can be in the range of from about 10% to about 50% open area, allowing an add on in the range of from about 1 to about 20% of the filter weight. By varying the applied pressure, the viscosity of the treating liquid and the permeability of the inner cylinder wall material, the liquid can be caused to issue from the inner wall in a manner which would be described as oozing, seeping, spurting or spraying, depending upon the requirements for application of the treating liquid to the rod.

Filtration means can be employed as appropriate in the feed means to the apparatus, and/or within the plenum chamber. For example, a filtering layer of a non-woven fabric could be wrapped around the outer surface of the inner cylinder to prevent undesired particulate matter from reaching the inner chamber and the porous cylinder therein.

While the process of this invention can be used to coat any continuous cylindrical product with a liquid, the fibrous materials suitable for the filamentary tow used in producing cigarette filters include cellulose esters and ethers, linear polyesters, polyolefins and polyamides. Examples of such cellulose esters include cellulose acetate, cellulose propionate, cellulose butyrate, cellulose benzoate, cellulose acetateformate, cellulose acetate-propionate, cellulose acetatebutyrate, and the like. Cellulose acetate is preferred at present as the commercially most acceptable filamentary tow for cigarette filter production. These esters can be conventional cellulose acetate, or may be substantially fully esterified, i.e. contain fewer than 0.29 free hydroxyl groups per anhydroglucose unit, such as cellulose triacetate. The ethers include substances such as ethyl cellulose. Polyesters useful in this invention include polyethylene terephthalate. Polyamides such as various nylons can be used. Suitable polyolefins include polyethylene, polypropylene and the like. If desired for certain purposes, the thermoplastic fibrous materials described above can be mixed with other fibrous or particulate materials such as cotton fibers, rayon, activated carbon powder and the like.

As a general rule, the composition of the filamentary material employed will dictate the plasticizing agent or other additive of preference. When cellulose esters are used, the plasticizer can generally be selected from the group consisting of polyalkylene glycols and esters thereof, organic solvents such as acetone and mixtures thereof. Examples of preferred plasticizers, triacetin, diethylene glycol diacetate, triethylene glycol diacetate, tetraethylene glycol diacetate, triethyl citrate, methyl phthalyl ethyl glycolate.

In the practice of this invention, the plasticizer can be used as a vehicle for introducing further additives into the filamentary tow material in a pattern of variable concentration. Such additives can be liquids or solids. Particulate solids which are insoluble in the plasticizer can be added to produce a suspension or slurry, provided the porosity or permeability of the inner cylinder of the apparatus is sufficient to permit passage of the particles without clogging. Such additives can serve to modify the structural or functional properties of the final product. For example, various absorbent or smoke modifying materials may be included to improve the filtration effected by the final product and/or change the effective pH of the smoke. Exemplary of such materials are activated carbon, silica gel, alkali metal aluminosilicates such as molecular sieves, sucrose, activated alumina, volcanic ash, granular calcium carbonate, granular sodium carbonate, Fuller's Earth, magnesium silicates, metallic oxides such as iron oxide and aluminum oxide, organic acids such as citric acid, the the like. Flavor modifiers such as menthol, citrus oils or other similar materials can be incorporated. In an embodiment wherein a liquid or volatile additive such as a flavor modifier is added by the method of the present invention, rather than in the typical prior art method wherein plasticizer is uniformly applied to all the fibers of the filter rod, which is then treated with hot air, an advantage is gained in that the present invention does not require any such air drying and consequently avoids loss of additive otherwise incurred in drying. In the absence of such waste, a reduced amount of such expensive additives is used to achieve the desired effect.

Furthermore, the apparatus and method of the present invention can be used to apply liquid additives, coatings or treatment materials primarily to the outer surface of a continuous cylindrical product. When the applicator is used to process a cigarette filter rod, for example, exemplary materials applied to the outside surface can include coloring agents, adhesive materials, resins and the like. Using this system, the rod can be coated prior to wrapping with paper, or coated with a resin or other material which will form a skin on the outer surface.

While the method of the present invention can be used to coat a variety of products such as tubing or wire which may be non-absorbent, the benefits are most apparent when it is employed to coat absorbent materials such as continuous filter rods. Application of liquids such as plasticizers to absorbent materials produces annular regions of radially varying concentration of the additive in the absorbent material as the liquid additive absorbs from outside to inside.

The applicator system and process of this invention can be designed and operated to produce maximum outer layer concentrations of liquid additive of any suitable value, preferably in the range of from about 1 to about 20 weight percent based on the weight of dry rod material. When a plasticizer is applied to a filter rod comprising fibers of materials such as cellulose acetate, with or without heat or steam treatment, an outer layer of plasticized fibers having an increased density is produced. This outer layer can modify the resiliency of a cigarette filter produced therefrom.

The following examples are given as specific illustrations of the claimed invention. It should be understood, however, that the invention is not limited to the specific details set forth. All parts and percentages in the examples as well as in the remainder of the specification and claims are by weight unless otherwise specified.

EXAMPLE 1

An AF-2 brush applicator system manufactured by Hauni-Werke Korber and Company KG of Hamburg, West Germany, which employs a holding tank or booth for liquid not picked up by tow was employed in conjunction with a Hauni KDF-2 cigarette rod making machine, the brush applicator being positioned immediately after the final tow opening device. The cigarette tow processed was cellulose acetate tow having 3.0 denier per filament and a total denier of 35,000. The apparatus was operated at a speed of 400 meters per minute so as to produce cigarette filter rods 102 millimeters in length having a 24.6 millimeters circumference and a tow weight of about 67.38 grams per 100 filter rods. The plasticizer applied was triacetin plasticizer adjusted so as to result in a pickup of 10% by weight based on the unplasticized filter rod weight. The rods were then subjected to physical testing as reported in Table 1 hereinafter.

EXAMPLE 2

An applicator system was constructed substantially as shown in FIGS. 1 and 2 of the drawings, using as the inner cylinder porous, seamless, sintered stainless steel tube (Mott Series A Marketed by Mott Metallurgical Corporation, Farmington, Conn.), providing a permeability of 0.2 to 5 gallons of $H_2O$ per hour at about 10 psi pressure applied to the outer surface. The applicator system as described was used in conjunction with a Hauni KDF-2 cigarette rod making machine manufactured by Hauni Werke Korber and Company KG of Hamburg, West Germany. The cigarette tow processed was cellulose acetate tow having 3.0 denier per filament and a total denier of 35,000. The apparatus was operated under the same conditions as set forth in Example 1 with plasticizer pickup adjusted so as to produce cigarette filter rods having triacetin plasticizer pickup of 10.0% by weight based on the unplasticized weight of the filter rod. The rods were then subjected to physical testing as reported in Table 1 hereinafter.

EXAMPLE 3

The brush applicator system of Example 1 and the peripheral applicator system of Example 2 were employed in conjunction with a Hauni KDF-2 cigarette rod making machine, the brush applicator being the initial applicator, and being operated at that point where the tow band has been deregistered and appropriately spread for uniform or homogeneous application of the plasticizer. The plasticizer applied from both plasticizer applicators was triacetin plasticizer, amounts applied from each plasticizer applicator being adjusted so as to result in a total pickup of 10% based on the unplasticized weight of the filter. Runs were conducted at 80% brush applicator delivery/20% peripheral applicator delivery, 60% brush applicator delivery/40% peripheral applicator delivery, 40% brush applicator delivery/60% peripheral applicator delivery, and 20% brush applicator delivery/80% peripheral applicator delivery. Rods produced from the runs were then subjected to physical testing as reported in Table 1 hereinafter.

EXAMPLE 4

The process of Example 2 was repeated except that triethylene glycol diacetate plasticizer was substituted for the triacetin plasticizer and pickup was adjusted so that a pickup of 6.7, 8.7, 10.6 and 11.1 percent by weight based on the unplasticized weight of the filter rod was obtained. The rods were subjected to analytical testing and the results reported in Table 2 hereinafter.

EXAMPLE 5

The process of Example 2 was repeated except that the pickup of triacetin plasticizer was adjusted so that a pickup of 10.6, 13.8 and 17.2 percent by weight based on the unplasticized weight of the filter rod was obtained. The rods were subjected to analytical testing and the results reported in Table 2 hereinafter.

Rods prepared according to Examples 1, 2 and 3 having a pickup 10% plasticizer based on the unplasticized weight of the filter were evaluated as follows: The rods were tested on a table model Instron metric Model TM-M manufactured by Instron Engineering Corporation, Canton, Mass. The Instron machine is equipped with a CC compression cell and the crosshead speed operated at 2 inches per minute with a chart speed of 12 inches per minute. A rod sample is inserted into the compression cell and the load run up to 2,000 grams, a reading being taken of millimeters rod depression immediately upon reaching 2,000 grams. The result of the Instron measurements are given in the following table designated as Table 1:

TABLE 1

| | Applicator | Millimeters Rod Depression |
|---|---|---|
| Example 1 | 100% Peripheral | .96 |
| Example 2 | 100% Brush | .33 |
| Example 3 | 80% Brush<br>20% Peripheral | .36 |
| Example 3 | 60% Brush<br>40% Peripheral | .41 |
| Example 3 | 40% Brush<br>60% Peripheral | .53 |
| Example 3 | 20% Brush<br>80% Peripheral | .66 |

The results of the foregoing table are graphically set forth in FIG. 4 of the drawings, which plots the ratio of booth or prior art plasticizer applicator to peripheral plasticizer applicator for each of six rod samples against millimeter rod depression as determined by the aforementioned Instron test. As can be seen, prior art homogeneous application of plasticizer results in minimal rod depression while the peripheral plasticizer application of the instant invention results in maximum rod depression with a combination of the two applicator systems producing rod depression intermediate the two extremes. Preferably the product of the instant invention has a rod depression in excess of 0.5 millimeters and most preferably from 0.5 to 1.0 millimeters. It should be noted that when peripheral plasticizer application constitutes 60% or more of the plasticizer applied, wrapping paper is substantially fully adhered about the periphery of the rod.

The rods of Examples 4 and 5 were also analyzed for core and periphery concentrations of plasticizer using the following method:

Four rods are selected at random. The filter rods are cut into segments approximately 20 mm in length. Each segment is then carefully cored using a #2 cork borer. The cut is centered around the longitudinal axis of the segment, so that for a segment 8 mm in diameter, a "shell" approximately 2 mm thick is separated from the inner core. Both shell and core are retained. When all segments have been cured, the weighed shells are placed in one bottle and the weighed cores are placed in another. A gas-chromatographic analysis was then conducted to determine plasticizer levels on filter rods.

The results obtained from the analyses of the filter rods thus treated with plasticizer are presented in Table 2 below.

TABLE 2

| Example | PZ[1] Type | % PZ, Whole Rod | % PZ, Periphery | % PZ Core |
|---|---|---|---|---|
| 4 | TEGDA[2] | 6.7 | 7.2 | 6.3 |
| 4 | TEGDA | 8.7 | 11.2 | 6.6 |
| 4 | TEGDA | 10.6 | 13.9 | 7.0 |
| 4 | TEGDA | 11.1 | 12.5 | 8.9 |
| 5 | Triacetin | 10.6 | 12.0 | 8.2 |
| 5 | Triacetin | 13.8 | 16.4 | 9.7 |
| 5 | Triacetin | 17.2 | 22.9 | 11.0 |

[1]Plasticizer
[2]Triethyleneglycol diacetate

These data show that the process and apparatus of the invention can be used to apply plasticizer to conventional filter rods in concentrations which are higher at the surface than at the core.

Although the invention has been described with preferred embodiments, it is to be understood that variations and modifications may be employed without departing from the concept of the invention as defined in the following claims.

We claim:

1. A process for forming a cigarette filter of the type comprising a cylindrical bundle of a compacted band of continuous filamentary tow material and treating liquid absorbed into the cylindrical bundle, said method comprising the steps of:

(a) applying a treating liquid, which consists essentially of a plasticizer, uniformly onto a band of continuous filamentary tow material, (b) compacting the band of continuous filamentary tow material treated according to step (a) to form a cylindrical bundle thereof, (c) applying another treating liquid, which may be the same as or different than the treating liquid applied according to step (a), onto the peripheral surface of said cylindrical bundle, and then (d) wrapping a paper about the peripheral surface of said compacted cylindrical bundle, and allowing the paper to be firmly adhered to the peripheral surface by means of the treating liquid applied according to step (c), the adhesion being accomplished in the absence of a glue material additionally applied thereto, wherein (e) not more than about 40% of the total weight of treating liquid which is absorbed into said cylindrical bundle is applied uniformly to said band of continuous tow material according to step (a) prior to compaction thereof into said cylindrical bundle according to step (b), while at least 60% of the total weight of treating liquid which is absorbed into the cylindrical bundle is applied on the peripheral surface of the cylindrical bundle formed according to step (b) thereby to produce a cigarette filter having a concentration of treating liquid which decreases radially inwardly from the peripheral surface of said cylindrical bundle to the core thereof and whose peripheral surface is depressed between about 0.5 mm to about 1.0 mm when subjected to a load of 2,000 grams.

2. A process as in claim 1 wherein step (a) is practiced by applying between about 1 to about 20 weight percent of the treating liquid uniformly to said band of continuous filamentary tow material prior to being compacted into said cylindrical bundle, and wherein the balance of the treating liquid which is absorbed into said cylindrical bundle is applied to the peripheral surface thereof according to step (c).

3. A process as in claim 1 which is practiced utilizing a cellulose ester as the continuous filamentary tow material and polyalkylene glycol as the plasticizer.

4. A process as in claim 1 which is practiced utilizing cellulose acetate as the continuous filamentary tow material.

5. A process as in claim 1 which is practiced utilizing at least one of triacetin, diethylene glycol diacetate, triethylene glycol diacetate, tetraethylene glycol diacetate, triethyl citrate, methyl phthalyl ethyl glycolate, or mixtures thereof, as the plasticizer.

* * * * *